United States Patent [19]

Sanchez

[11] Patent Number: 5,024,628

[45] Date of Patent: Jun. 18, 1991

[54] MATERNITY AND NURSING BRASSIERE WITH STRAP VARIATIONS

[76] Inventor: Mary M. Sanchez, 5246 S. Camino de la Tierra, Tucson, Ariz. 85746

[21] Appl. No.: 482,213

[22] Filed: Feb. 20, 1990

[51] Int. Cl.[5] ..... A41C 3/04

[52] U.S. Cl. ..... 450/36; 450/37; 450/47; 450/68; 450/86; 2/104

[58] Field of Search ..... 2/73, 104; 450/36, 37, 450/38, 40, 41, 47, 63, 68, 72, 80, 86, 87, 88

[56] References Cited

U.S. PATENT DOCUMENTS

| | | | |
|---|---|---|---|
| 1,136,727 | 4/1915 | Smith | 450/36 |
| 1,211,699 | 1/1917 | Guinzburg | 450/36 |
| 1,217,441 | 2/1917 | Guinzburg | 450/36 |
| 1,272,427 | 7/1918 | Haderlein | 450/37 |
| 1,956,250 | 4/1934 | Rosenthal | 450/37 |
| 1,989,382 | 1/1935 | Schnaittacher | 450/37 X |
| 2,055,094 | 9/1936 | Zweben | 450/86 |
| 2,562,669 | 7/1951 | Keller | 450/36 |
| 2,585,338 | 2/1952 | Meares | 450/36 |
| 2,666,919 | 8/1954 | Spangard | 2/104 X |
| 2,679,048 | 5/1954 | Alberts | 450/36 |
| 2,782,418 | 2/1957 | Garson | 450/86 |
| 2,817,089 | 12/1957 | Oelbaum | 450/86 X |
| 2,925,816 | 2/1960 | Rosenthal | 450/37 |
| 3,311,112 | 3/1967 | Murray | 450/88 |
| 3,489,153 | 1/1970 | Gaisser | 450/88 |
| 3,939,845 | 2/1976 | Guidoni | 450/68 |
| 4,024,876 | 5/1977 | Penrock | 450/86 |
| 4,222,387 | 6/1980 | Tetu | 450/36 |
| 4,276,884 | 7/1981 | O'Daniels | 450/86 |
| 4,390,024 | 6/1983 | Williams | 450/36 |
| 4,612,935 | 9/1986 | Greifer | 450/86 |
| 4,633,876 | 1/1987 | Scullin | 450/36 |
| 4,640,287 | 2/1987 | Anderson et al. | 450/36 |
| 4,648,404 | 3/1987 | Clark | 2/104 X |
| 4,798,557 | 1/1989 | Scott | 450/47 X |
| 4,858,249 | 8/1989 | Stewart | 2/305 |
| 4,878,879 | 11/1989 | Kunstadter | 450/36 |

FOREIGN PATENT DOCUMENTS

| | | | |
|---|---|---|---|
| 627409 | 9/1961 | Canada | 450/36 |
| 3617703 | 12/1986 | Fed. Rep. of Germany | 450/36 |
| 1146838 | 3/1969 | United Kingdom | 450/41 |

OTHER PUBLICATIONS

Gershman, Maurice, "Self Adhering Nylon Tapes", The J.A.M.A., vol. 468, No. 7, Oct. 1958.

*Primary Examiner*—Werner H. Schroeder
*Assistant Examiner*—Jeanette E. Chapman
*Attorney, Agent, or Firm*—Victor Flores

[57] ABSTRACT

The present invention teaches a maternity and nursing bra incorporating a one-handed fastening method that inherently allows for a stronger cup support and variable adjustment of cup size. It is accomplished by affixing parts of a fastener to the inside of an inner cup (17) to an inner band (15). Also incorporated into the inside of the inner cup (17) is an optional use nursing pad pocket (18). The bra's variable strap width adjusting band (12) and the relocatable shoulder straps (10) enables the bra to be worn with a variety of outer garment styles.

9 Claims, 4 Drawing Sheets

MATERNITY AND NURSING BRASSIERE WITH STRAP VARIATIONS

BACKGROUND

1. Field of Invention

This invention relates to maternity and nursing bras specifically to fastening and wearing means.

2. Description of Prior Art

Heretofore, maternity and nursing bras did not allow for discreet nursing of a child due to the location of the devices used to expose the nipples or to the hinderance of those devices. A two-handed operation was required of the woman who normally only had one hand available while the other hand supported the baby. Also preventing discreet nursing was the lack of support for nursing pads which often resulted in those pads falling to the floor upon release of the breast cup. Moreover, many previous types of nursing bras did not easily adjust to changes in breast size and often necessitated the need for a different sized nursing bra after the breasts adjusted to the infant's exact demand. As also has been the case in nursing, the breasts themselves may vary in size for an extended period of time especially when the child shows a preference for one breast over another. Lastly, the user was limited in the type of outer garments to wear because the previous maternity and nursing bras did not provide any means in which to alter the configuration of the supporting straps.

U.S. Pat. No. 4,640,287 issued to Anderson et al on Feb. 3, 1987 discloses an easy fastening means located longitudinally on the shoulder strap but with no variation in placement of shoulder straps nor adjustment in cup size.

U.S. Pat. No. 4,633,876 issued to Scullin on Jan. 6, 1987 shows a "foldover"panel that employs no fastening means but requires some dexterity and, therefore, length of time to expose the entire areola for comfortable nursing of an infant.

U.S. Pat. No. 4,390,024 issued to Williams on Jun. 28, 1983 makes use of a multiple adjustable means located again on the shoulder strap but with no variation of said strap.

U.S. Pat. No. 4,222,387 issued to Tetu on Sept. 16, 1980 uses a detachable securing means along the entire periphery of its cup for this prosthesis bra. To re-attach quickly in order to be discreet cannot be done should this design be incorporated into a nursing bra.

U.S. Pat. No. 3,939,845 issued to Guidoni on Feb. 24, 1976 has patented a brassiere with ties for adjustment of height, width and depth of each pouch or cup as well as lateral ties to position brassiere with respect to shoulders. However, the design does not provide overall support of breasts that is needed for lactating women.

U.S. Pat. No. 2,925,816 issued to Rosenthal on Feb. 23, 1960 shows a two-handed operation for refastening to the hook with no variation in strap placement.

U.S. Pat. No. 2,666,919 issued to Spangard on Jan. 26, 1954 shows an easily unfastened bra flap using a quick action slide fastener but not so easily refastened especially with larger breast sizes.

U.S. Pat. No. 2,585,338 issued to Meares on Feb. 12, 1952 consists of a bust supporter which has pockets for removable drip pads located inwardly on the main portion of the cup. These pockers do not secure the pad and, therefore, the pads tend to fall out of the bra.

As clearly seen in such prior art, most maternity brassieres designed with detachable means either at the front of the shoulder straps or in the center front of the brassiere have failed in providing an expedient, discreet manner in which to open and close cups for nursing and have failed more so in providing a well-fitting bra during all phases of the wearing due to the normal fluctuations in breast size.

SUMMARY OF THE INVENTION

Therefore, several objects and advantages of the present invention are:

(a) to provide a truly one-handed fastening and unfastening operation that will provide for discreet nursing.

(b) to provide a stronger support means in the cup design especially for the larger cup sizes.

(c) to provide a variable adjustment in the cup design will accommodate the natural changes in the size of the breast.

(d) to provide a pocket for holding a nursing pad in place.

(e) to provide alternate placement of the shoulder straps with adjustable means of those straps for different wearing styles.

The attaching means shown for the cups described herewith and as illustrated in the drawings has detailed a popular system of fastening in the art and is known s a Velcro fastener available under the trademark "Velcro" from the Velcro Corp., New York. However, the scope of the present invention is not to be restricted to such means but may employ other fastening devices such as snaps or hooks. The restrictions in fastening means should not apply either to the means detailed in the drawings for the adjustment of the shoulder straps since they may be as readily constructed with other well-known devices such as snaps.

Further objects and advantages are to provide a functional nursing bra that allows for the discreet nursing of an infant by a truly simple one-handed operation of the nursing flaps. In the simplicity of this design, the need for varying cup sizes to accommodate the fluctuation in breast size during the maternity phase and lactation phase is also provided for. Also the versatility in style accomplished by the simple relocation of the shoulder straps is one advantage that has been neglected by the industry. Still further objects and advantages will become apparent from a consideration of ensuing description and drawings.

Therefore, the foregoing objects of the invention are accomplished by providing a brassiere apparatus having an encircling band for securing said brassiere to a backside of a wearer, said encircling band having a plurality of horizontally spaced attachment points, a pair of shoulder straps attached at one end to an upper brassiere support band and detachably attached at the other end to said encircling band at selected ones of said horizontal attachment points to effect controllable strap width setting, each of said shoulder straps having a plurality of corresponding vertically spaced attachment points located proximate said other end. The brassiere apparatus also having at least one strap width adjusting band, said strap width adjusting band being detachably attached to selectable ones of said vertically spaced attachment points to maintain said strap width setting at vertically spaced distances above said encircling band. The brassiere apparatus is also provided with a pair of detachable breast cup means for facilitating breast feeding, each of said breast cup means having breast size compensation means for accommodating variable breast sizes experienced by a wearer during a breast feeding phase, said breast size compensation means comprising a first detachable closure member located on an upper perimeter portion of said breast cup means and a second mating closure member located on the upper brassiere support band, said first closure member being controllably and detachably attached to selectable width portions on said second closure member to effect breast size fitting compensation such that said breast cup means comfortably conforms to said variable breast sizes. The brassiere apparatus of the present invention also provides on each of said breast cup means a nursing pad pocket formed between an inner gauze liner and an exterior surface of said cup means, said nursing pad pocket having an entry way formed to be accessible from within the outer side of said breast cup means.

Therefore, to the accomplishments of the foegoing objects, the invention consists of the foregoing features hereinafter fully described and particularly pointed out in the claims, the accompanying drawings and the following disclosure describing in detail the invention, such drawings and disclosure illustrating but one of the various ways in which the invention may be practiced.

REFERENCE NUMERALS IN DRAWINGS

Figure 1:
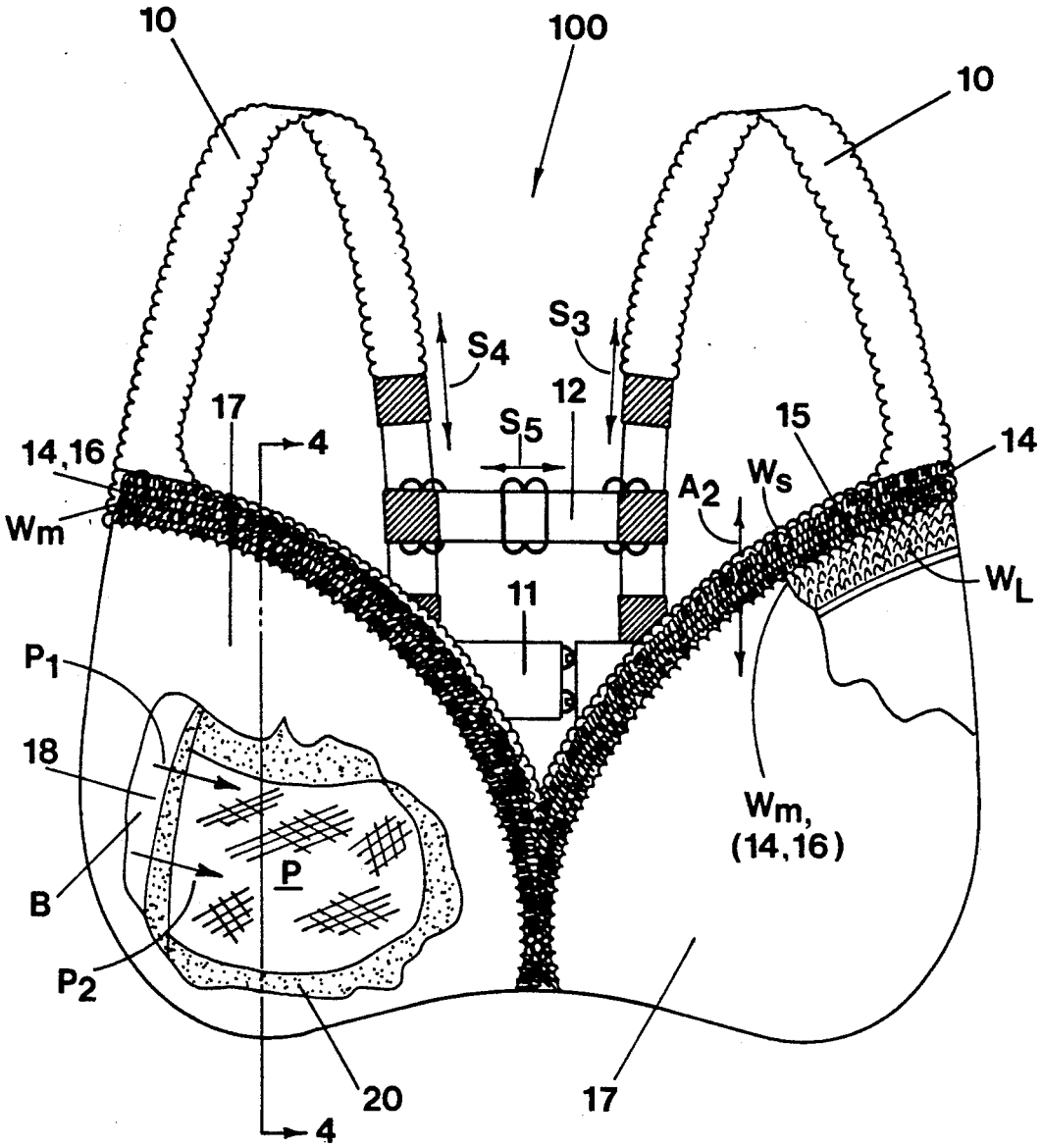
FIG. 1 is a front elevation of a brassiere constructed in accordance with my invention showing various aspects of alterable shoulder straps and a cut-away view of the right cup showing a nursing pad being held securely in place aftrer being inserted from an outer side of an interior pocket of the detachable/breast size adjustable cup and further illustrating the breast size cup adjustment feature.

10 shoulder straps
11 body encircling band
12 variable strap width adjusting band
14 loop members of Velcro
15 inner band
16 hook members of Velcro
17 inner cup
18 nursing pad pocket
20 material for nursing pad pocket
21 seam accommodating underwire support
22 hook for loop
24 loop catch
26 eye
28 hook for eye
P1 nursing pad insertion direction arrow,
P2 nursing pad insertion direction arrow,
P nursing pad,
N nipple,
S1 left shoulder strap horizontal adjustment arrow,
S2 right shoulder strap horizontal adjustment arrow,
S3 left shoulder strap vertical adjustment arrow,
S4 right shoulder strap vertical adjustment arrow,
S5 variable strap width adjustment arrow,
A1 inner cup open/close motion arrow,
A2 inner cup closure point adjustment arrow,
B breast, generally,
Bs small sized breast due to active nursing,
Bm medium sized breast due to moderate nursing,
Bl large sized breast due to low nursing activity,
W1 inner band width
W2 hook members width,
Ws small breast size attachment point on inner band,
Wm medium breast size attachment point on inner band,
Wl large breast size attachment point on inner band.

DESCRIPTION OF THE PREFERRED EMBODIMENT

Referring now to FIG. 1 showing a maternity brassiere (bra) 100 according to the present invention. Bra 100 comprises a pair of detachably secured inner cups 17, straps 10, and body encircling band 11. Detachably secured inner cups 17 are shown in a closed position, where, by example only, a nursing pad P is securely held in a nursing pad pocket 18 forward of a nipple N, see FIG. 2, pocket 18 having an opening on an outer side of the interior side of cups 17 for placement of pad P. Pocket 18 being formed utilizing a gauze-type material 20 sewn at the bottom in the seam connecting the underwire supports 21 to the inner cups 17 and at the top to a seam attaching hook Velcro member 16, see FIG. 4. Pocket 18's opening is preferably located for pad P entry as shown by pad placement direction arrows P1 and P2 to prevent inadvertent flying-out of pad P during a discreet nursing session requiring opening of inner pad 17 to expose the breast B, as depicted by open/closure arrow A1, see FIG. 2.

Figure 2:
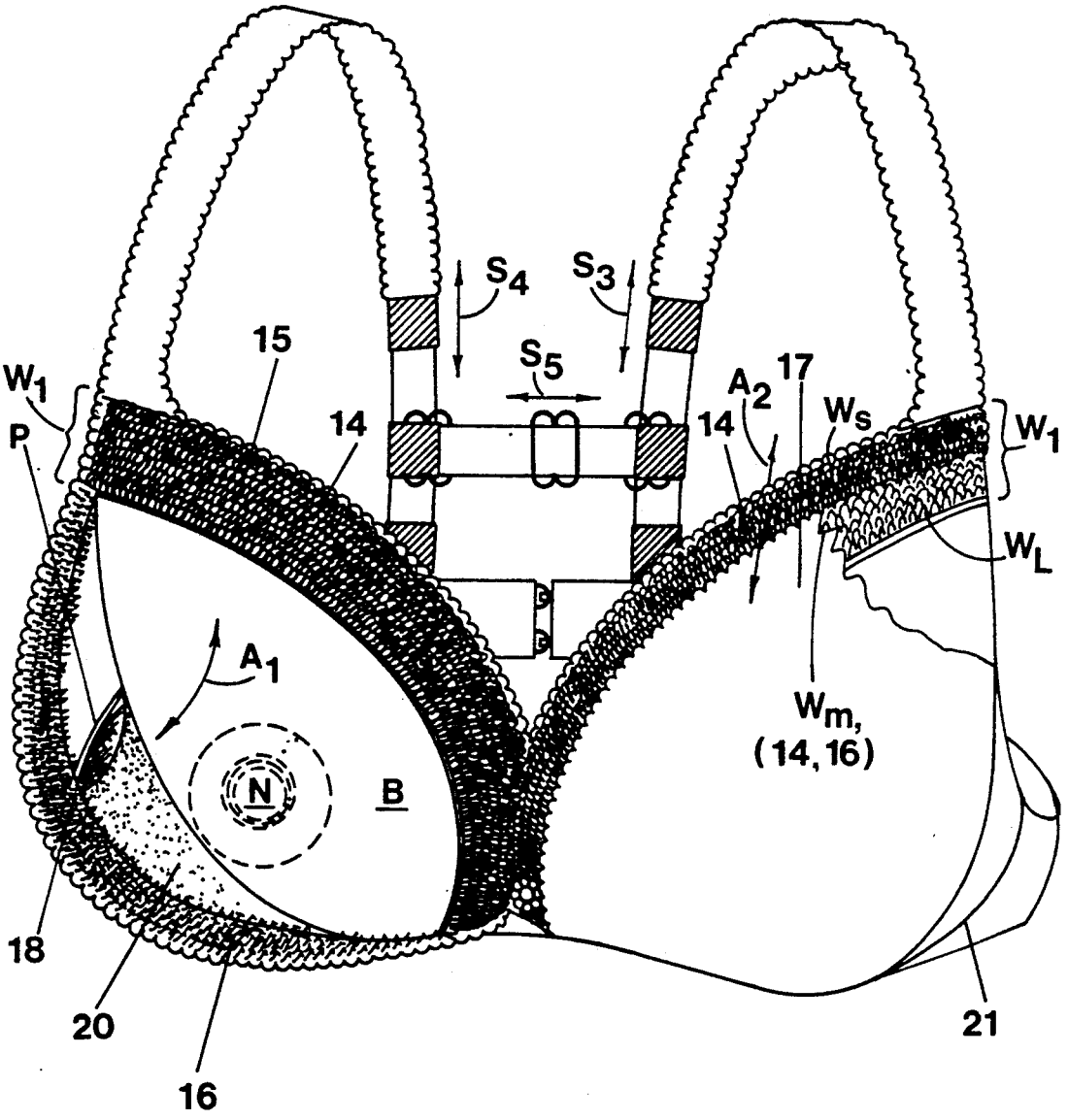
FIG. 2 is a front elevation showing the cup open for nursing purposes and the securely held nursing pad after being inserted from an outer side pocket opening.

Inner cups 17 are preferably constructed with enough material to overlay onto the inner band 15 and may use stretchable or non-stretchable fabrics commonly used in the industry. The inner cups 17 may, according to the size needed, be constructed with a single piece of material or with multiple panels stitched together in conventional fashion. The attaching means for cups 17 comprises sewing of Velcro 16 hook members, having a width W2, (see FIG. 4), positioned to be variably overlayed onto loop members of Velcro 14, having a width W1, (see also FIG. 4), which loop members 14 are permanently sewn onto the inner band 15. FIG. 1 and 2 illustrate the placement on the wide inner band 15 of the loop members of Velcro 14 with the width W1 of the band 15 being determined in relation to the overall size of the bra. The result of this cup size adjustment feature is to produce a varying cup size positionable as indicated by positioning arrow A2 to comfortably fit a nursing breast B having varying sizes ranging from small, Bs, due to active nursing, medium, Bm, due to moderate nursing or large B1, due to low nursing activity, (see FIG. 4) and yet maintaining in this variation a smoothly contoured and well-fitting brassiere cup by easily and quickly attaching along widths W1, W2 to corresponding small breast attachment point Ws, medium breast attachment point Wm or large breast attachment point W1. Inner cups 17 illustrated in FIG. 1 being attached at Wm with compression mating of hooks 16 with loops 14 and assuming a medium sized nursing breast. The ease of fastening inherent in this design fulfills the demand for a functional nursing bra that allows the user to be discreet and also to obtain a conforming fit.

Figure 3A:
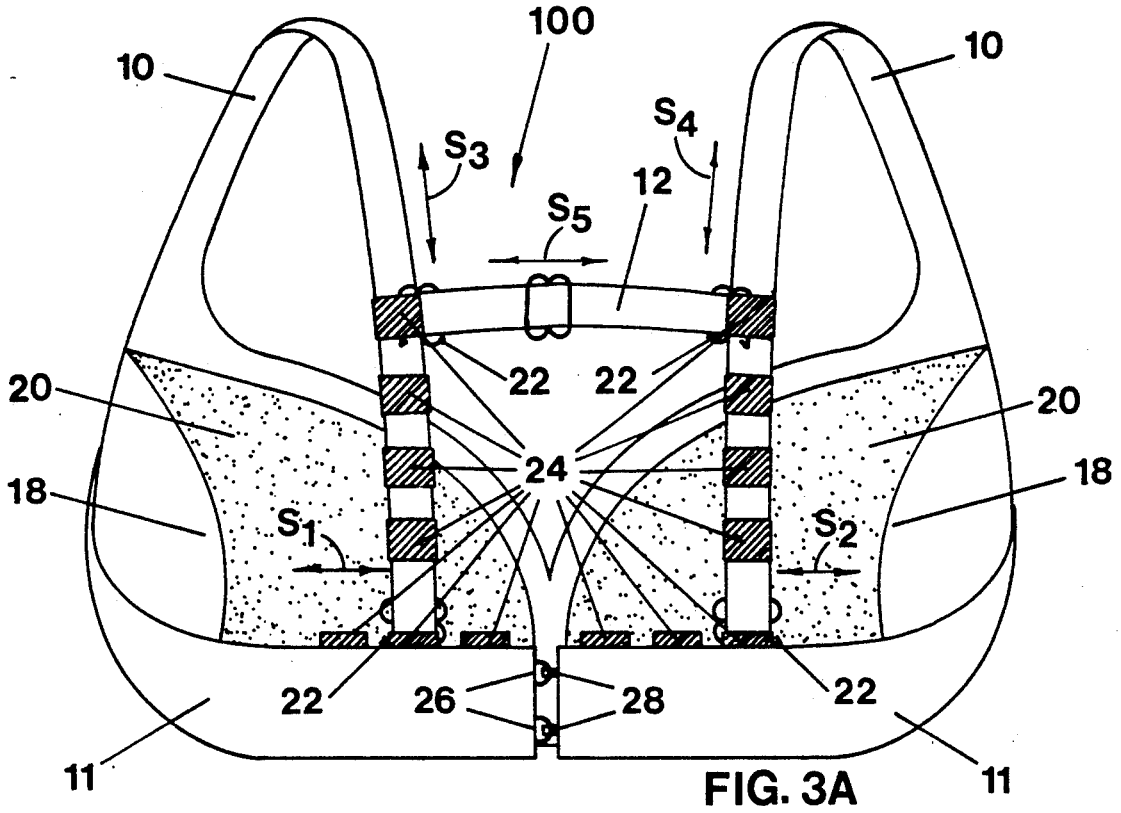
FIG. 3A is a back view of the present invention illustrating the shoulder strap width adjustment feature including utilization of horizontal attachment points along the body encircling band and a plurality of vertical height adjustment points on the shoulder straps utilizing the strap width adjustment band.
Figure 3B:
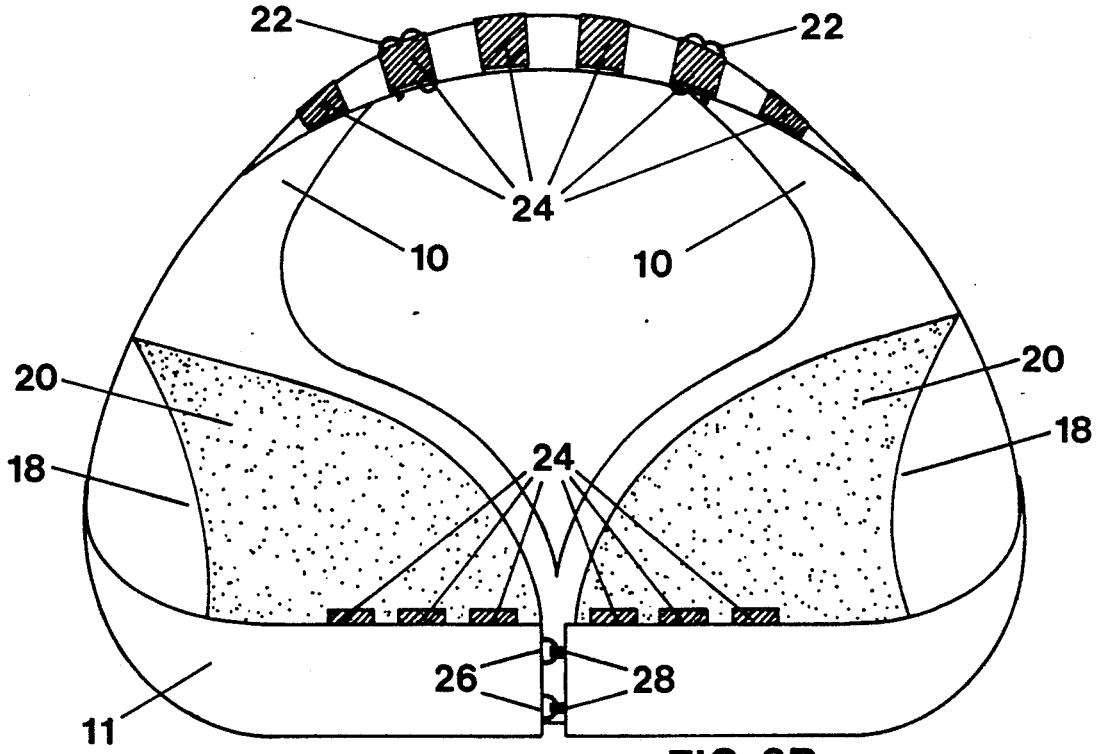
FIG. 3B is a rear elevation similar to FIG. 3A showing another possible placement of the shoulder straps excluding, however, the variable width adjustment band.

As stated previously, the construction of the present maternity bra invention involves the usual body encircling band 11 opening at the rear with the standard eye 26 and hook for the eye 28 as shown in FIG. 3A and 3B.

Figure 4:
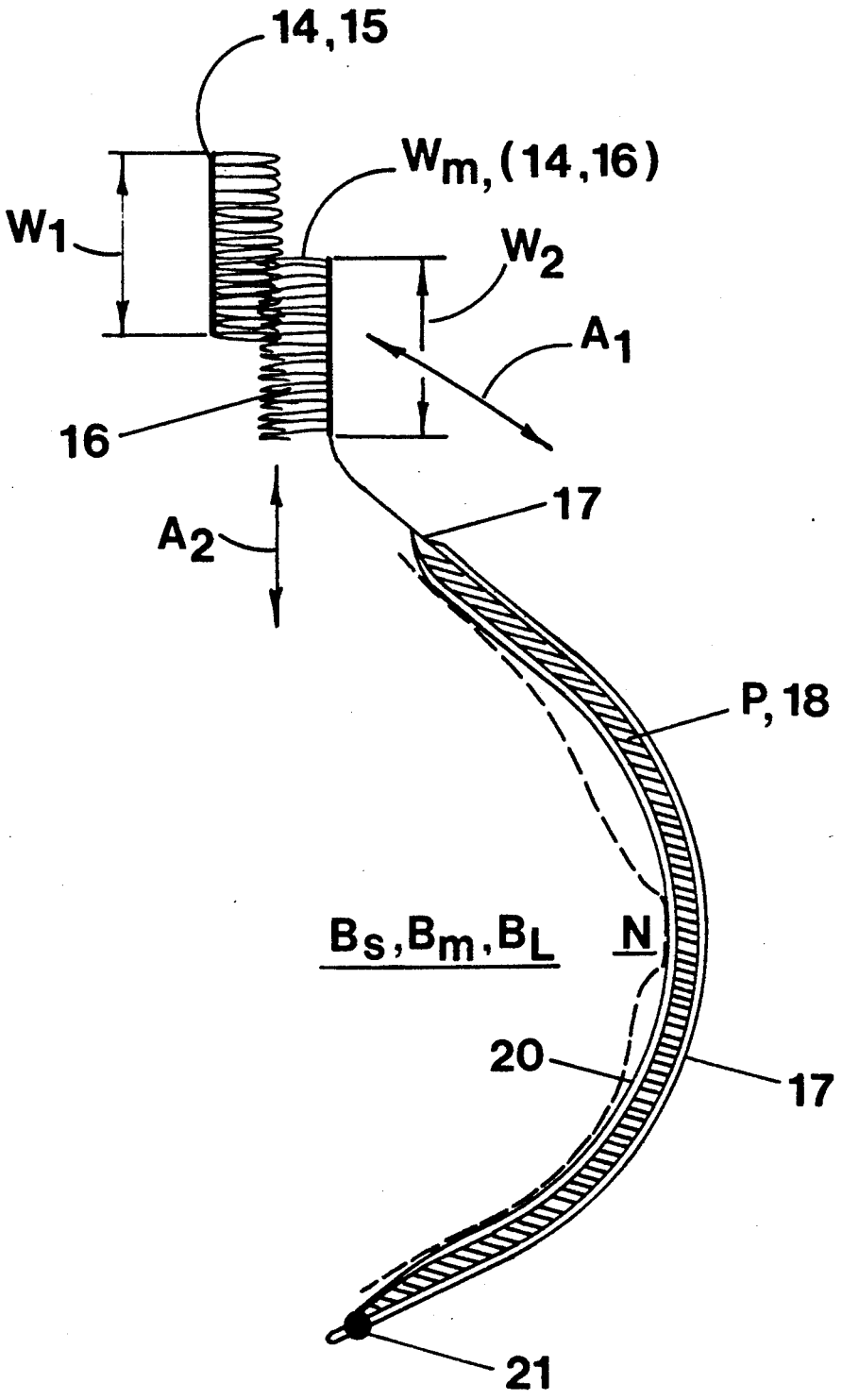
FIG. 4 is a cross-sectional view of the right cup, having a superimposed breast for illustration purposes only, taken along the line 4-4 of FIG. 1 illusrating the cup's interior nursing pad pocket and the breast size adjustment feature.

Conventional underwire supports 21 may be sewn connecting body encircling band 11 to inner cup 17 as shown in FIGS. 2 and 4.

An important embodiment of the present invention is the user's greater flexibility in the types of clothes she can wear. FIG. 3A illustrates the use of the variable strap width adjusting band 12 for use to variable aid in maintaining, in a variable vertical manner, a strap width as set at the encircling band 11, i.e. a wearer may adjustably set straps 10 at a particular setting along the terminating ends of strap 11, as indicated by arrows S1 and S2. The setting is augmented by utilization of band 12 and set to a desired setting in vertical and horizontal directions S3, S4 and S5, respectively. By example, the setting may be effected by inserting the hook for loops 22 into different loop catches 24 located on straps 10 and on encircling band 11 as shown in FIG. 3A. The placement of all parts being dictated by the outer garment's style and how much straps 10 need to narrowed to avoid visability. The utilization of band 12 enables a wearer to control the location of where straps 10 drape over their shoulders, i.e. the closer to the neck area straps 10 are desired to be set the closer together they are attached on band 11 and the higher up band 12 is attached on straps 10.

FIG. 3B shows a variation of style in the present design. Removal of variable strap width adjusting band 12 and removal of shoulder strap 10 from the body encircling band's loop catches 24 allows a halter-type garment to be worn. The hook for loops 22 on the end of shoulder strap 10 are then inserted into the other shoulder strap's loop catches 24.

Accordingly, the present invention provides a solution to the need of a functional, discreet, versatile bra that can be worn through all phases of maternity and lactation.

The specifications of my above description should not be construed as limitations on the scope of the invention but rather as a preferred exemplification thereof. It is also to be understood that the embodiments described above could be incorporated into other articles of clothing such as swimsuits, shirts, dresses or gowns for example.

Therefore, the scope and essence of this invention should not be determined solely by the embodiments illustrated, but by the appended claims and their legal equivalents.

What is claimed is:

1. A brassiere apparatus, said brassiere apparatus comprising:

a pair of detachable breast cup means for facilitating breast feeding, each of said breast cup means having breast size compensation means for accommodating variable breast sizes experienced by a wearer during a breast feeding phase, said breast size compensation means comprising a first detachable closure member located on an upper perimeter portion of said breast cup means and a second mating closure member located on an upper brassiere support band, said first closure member being controllably and detachably attached to selectable width portions on said second closure member to effect breast size fitting compensation such that said breast cup means comfortably conforms to said variable breast sizes;

a encircling band for securing said brassiere apparatus to a backside of a wearer, said encircling band having a plurality of horizontally spaced attachment points; and a pair of shoulder straps attached at one end to said upper brassiere support band and detachably attached at other end to said encircling band at selected ones of said horizontal attachment points to effect controllable strap width setting, each of said shoulder straps having a plurality of corresponding vertically spaced attachment points located proximate said other end.

2. A brassiere apparatus as recited in claim 1, wherein:

each of said breast cup means further comprises having a nursing pad pocket formed between an inner gauze liner and an exterior surface of said cup means, said nursing pad pocket having an entry way formed to be accessible from within the outer side of said breast cup means.

3. A brassiere apparatus as recited in claim 1, wherein said brassiere apparatus further comprises:

at least one width adjusting band, said width adjusting band being detachably attached to selectable ones of said vertically spaced attachment points to maintain said strap width setting at vertically spaced distances above said encircling band.

4. A brassiere apparatus as recited in claim 1, wherein said apparatus further comprises:

said pair of shoulder straps having hook means at said other end, that, instead of being detachably attached to said encircling band, being alternatively detachably attached to each other utilizing said hook means for joining to corresponding ones of said vertically spaced attachment points.

5. A brassiere apparatus, said brassiere apparatus comprising:

a pair of detachable breast cup means for facilitating breast feeding, each of said breast cup means having breast size compensation means for accommodating variable breast sizes experienced by a wearer during a breast feeding phase, said breast size compensation means comprising a first detachable closure member located on an upper perimeter portion of said breast cup means and a second mating closure member located on an upper brassiere support band, said first closure member being controllably and detachably attached to selectable width portions on said second closure member to effect breast size fitting compensation such that said breast cup means comfortably conforms to said variable breast sizes, each of said breast cup means further comprises having a nursing pad pocket formed between an inner gauze liner and an exterior surface of said cup means, said nursing pad pocket having an entry way formed to be accessible from within the outer side of said breast cup means;

an encircling band for securing said brassiere apparatus to a backside of a wearer, said encircling band having a plurality of horizontally spaced attachment points; and a pair of shoulder straps attached to one end to said upper brassiere support band and detachably attached at other end to said encircling band at selected ones of said horizontal attachment points to effect controllable strap width setting, each of said shoulder straps having a plurality of corresponding vertically spaced attachment points located proximate said other end.

6. A brassiere apparatus as recited in claim 5, wherein said brassiere apparatus further comprises:

at least one width adjusting band, said width adjusting band being detachably attached to selectable ones of said vertically spaced attachment points to maintain said strap width setting at vertically spaced distances above said encircling band.

7. A brassiere apparatus as recited in claim 5, wherein said apparatus further comprises:

said pair of shoulder straps having hook means at said other end, that, instead of being detachably attached to said encircling band, being alternatively detachably attached to each other utilizing said hook means for joining to corresponding ones of said vertically spaced attachment points.

8. A brassiere apparatus, said brassiere apparatus comprising:

an encircling band for securing said brassiere apparatus to a backside of a wearer, said encircling band having a plurality of horizontally spaced attachment points;

a pair of shoulder straps attached to one end to an upper brassiere support band and detachably attached at other end to said encircling band at selected ones of said horizontal attachment points to effect controllable strap width setting, each of said shoulder straps having a plurality of corresponding vertically spaced attachment points located proximate said other end;

at least one width adjusting band, said width adjusting band being detachably attached to selectable ones of said vertically spaced attachment points to maintain said strap width setting at vertically spaced distances above said encircling band; and a pair of detachable breast cup means for facilitating breast feeding, each of said breast cup means having breast size compensation means for accommodating variable breast sizes experienced by a wearer during a breast feeding phase, said breast size compensation means comprising a first detachable closure member located on an upper perimeter portion of said breast cup means and a second mating closure member located on an upper brassiere support band, said first closure member being controllably and detachably attached to selectable width portions on said second closure member to effect breast size fitting compensation such that said breast cup means comfortably conforms to said variable breast sizes.

9. A brassiere apparatus as recited in claim 8, wherein:

each of said breast cup means further comprises having a nursing pad pocket formed between an inner gauze liner and an exterior surface of said cup means, said nursing pad pocket having an entry way formed to be accessible from within the outer side of said breast cup means.

* * * * *